US008251240B2

(12) United States Patent
Seelhofer

(10) Patent No.: US 8,251,240 B2
(45) Date of Patent: Aug. 28, 2012

(54) PLASTIC CLOSURE COMPRISING A SLIDE OPENING FOR A BOTTLE NECK OR CONTAINER NECK

(75) Inventor: Fritz Seelhofer, Lindau (CH)

(73) Assignee: Nestec S.A., Vevey (CH)

( * ) Notice: Subject to any disclaimer, the term of this patent is extended or adjusted under 35 U.S.C. 154(b) by 501 days.

(21) Appl. No.: 12/293,487

(22) PCT Filed: Apr. 24, 2007

(86) PCT No.: PCT/EP2007/003584

§ 371 (c)(1),
(2), (4) Date: Oct. 16, 2008

(87) PCT Pub. No.: WO2007/121982

PCT Pub. Date: Nov. 1, 2007

(65) Prior Publication Data

US 2009/0261055 A1 Oct. 22, 2009

(30) Foreign Application Priority Data

Apr. 25, 2006 (CH) ..... 688/06

(51) Int. Cl.
*B65D 51/18* (2006.01)

(52) U.S. Cl. ..... 220/253; 220/212

(58) Field of Classification Search ..... 220/253, 220/212, 361, 254, 336, 344, 86.1, 507, 222; 206/1.5, 540, 534, 538, 539
See application file for complete search history.

(56) References Cited

U.S. PATENT DOCUMENTS 1,789,955 A 1/1929 Brownson
1,756,249 A * 4/1930 Kaufman ..... 215/307
2,106,364 A * 1/1938 Thorn ..... 222/507
(Continued)

FOREIGN PATENT DOCUMENTS

DE 423243 12/1925
(Continued)

OTHER PUBLICATIONS

International Search Report for International Application No. PCT/EP2007/003584 mailed on Oct. 11, 2007.

(Continued)

*Primary Examiner* — J. Gregory Pickett
*Assistant Examiner* — Ernesto Grano
(74) *Attorney, Agent, or Firm* — K&L Gates LLP

(57) ABSTRACT

The plastic closure consists of a rotating cap (1) with a sectoral pouring hole and with a slide (2) guided on its under side in such a way as to be capable of being displaced in a translational manner in relation to the pouring hole. The slide exhibits a downward-projecting cam on its under side. Lying beneath the slide (2) is a gate cap (3). Also present in its cover (6) is a sectoral pouring hole and behind it additionally a groove as a gate guide for the cam on the slide (2). The gate cap (3) is installed in a stationary manner on a bottle neck or a container spout. If the rotating cap (1) is caused to rotate relative to the gate cap (3), the cam of the slide will be guided along the gate guide and will pull the slide (2) into the open position, whereas rotation in the opposite direction will cause the slide (2) to be displaced back into the closed position.

5 Claims, 6 Drawing Sheets

U.S. PATENT DOCUMENTS

| | | | | | |
|---|---|---|---|---|---|
| 2,170,955 | A | * | 8/1939 | Thorn | 222/507 |
| 2,302,972 | A | * | 11/1942 | Nuckols | 222/517 |
| 4,011,829 | A | * | 3/1977 | Wachsmann et al. | 116/308 |
| 4,141,461 | A | * | 2/1979 | LaChance | 220/253 |
| 4,190,173 | A | * | 2/1980 | Mason et al. | 220/203.05 |
| 4,598,837 | A | * | 7/1986 | Kreiseder et al. | 220/253 |
| 4,696,410 | A | * | 9/1987 | Kreiseder | 220/267 |
| 5,072,849 | A | * | 12/1991 | Blau | 220/253 |
| 5,242,075 | A | * | 9/1993 | Ott et al. | 220/361 |
| 5,738,236 | A | * | 4/1998 | Brun, Jr. | 220/253 |
| 5,904,267 | A | * | 5/1999 | Thompson | 220/592.16 |
| 6,010,029 | A | * | 1/2000 | Wang | 220/714 |
| 2006/0071031 | A1 | | 4/2006 | DeJonge | |
| 2006/0283859 | A1 | * | 12/2006 | Lu | 220/253 |

FOREIGN PATENT DOCUMENTS

| | | |
|---|---|---|
| EP | 132189 | 5/1986 |
| WO | WO 9427883 | 12/1994 |

OTHER PUBLICATIONS

Written Opinion for International Application No. PCT/EP2007/003584 mailed on Oct. 11, 2007.

* cited by examiner

PLASTIC CLOSURE COMPRISING A SLIDE OPENING FOR A BOTTLE NECK OR CONTAINER NECK

BACKGROUND

This invention relates to a plastic closure for bottle-like containers, which contain bulk goods such as coffee granules or milk powder, granular bulk goods such as rice or rolled oats, but also bulk goods from the non-food area such as washing powder and the like.

Plastic bottles with a volume of approximately one liter for coffee whitener, which are particularly popular in the USA, are already familiar. A bottle of this kind exhibits a screw neck, of which the diameter is approximately the same as that of the bottle itself, namely in the order of 8 to 10 cm. A screw cap is then fitted on this neck. The screw cap is unscrewed from the neck to permit the pouring or removal of powder, and the bottle can then be tipped to an inclined position, depending on the level to which it is filled, and the contents can be shaken out by a gentle shaking action. Otherwise, a measuring spoon can be introduced into the interior of the bottle, and spoon-sized portions of the powder can be removed. The disadvantage associated with a rotating cap cover of this kind is that it must be unscrewed completely from the bottle and removed in order to permit removal of the contents. If one then takes the bottle away from the cap, the cap can be lost. It would thus be desirable to have a closure that is similarly compact to a rotating cap, but which does not require to be removed to permit measuring out of the contents. This closure should be easy to operate and economical to manufacture.

SUMMARY

This object is achieved by a plastic closure with a slide opening for a bottle neck or a container spout consisting of a rotating cap with a sectoral pouring hole and with slides guided on its under side in such a way as to be capable of being displaced in a translational manner in relation to the pouring hole and having cams protruding downwards for closing and opening the pouring hole, together with a gate cap fitting into the under side of the rotating cap having a groove as a gate guide, into which groove the cam of the slide projects, and ahead of the groove a pouring hole, the rotating cap being capable of rotation on the gate cap intended for stationary installation on a bottle neck or a container spout, as a result of which the relative movement of the rotating cap and the gate cap produces a displacement of the cam along the gate guide, so that the slide is capable of displacement in a translational manner into the open position and the closed position.

An advantageous embodiment of this plastic closure with a slide opening is depicted in the drawings in various views. These individual parts and their interaction on the installed closure are described and explained below.

DETAILED DESCRIPTION

Figure 1:
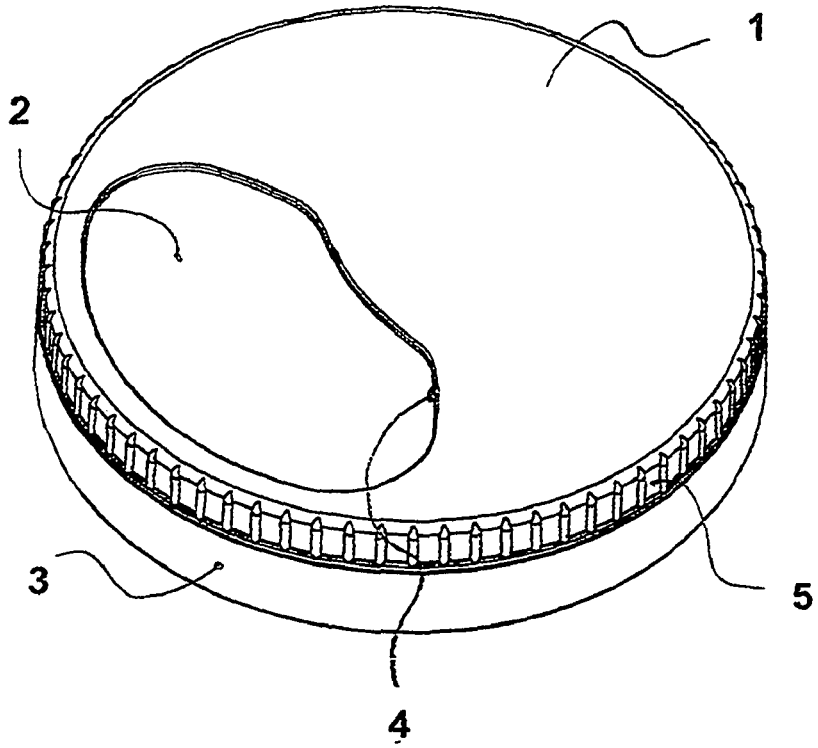
FIG. 1: depicts the assembled plastic closure with a slide opening viewed at an angle from above, in the closed state.

FIG. 1 depicts the assembled plastic closure with a slide opening viewed at an angle from above, with the slide in the closed state, and thus also the closure. The closure consists of three parts, these being firstly a rotating cap 1, which exhibits a pouring hole in an angular sector that is bounded by the edge 4, secondly a slide 2, which is guided on the under side of the rotating cap in such a way as to be capable of being displaced in a translational manner, and thirdly a gate cap 3, of which only the downward-projecting edge is visible here, by means of which this gate cap 3 can be pressed, screwed or snapped onto a neck of a bottle or a spout of a container.

Figure 2:
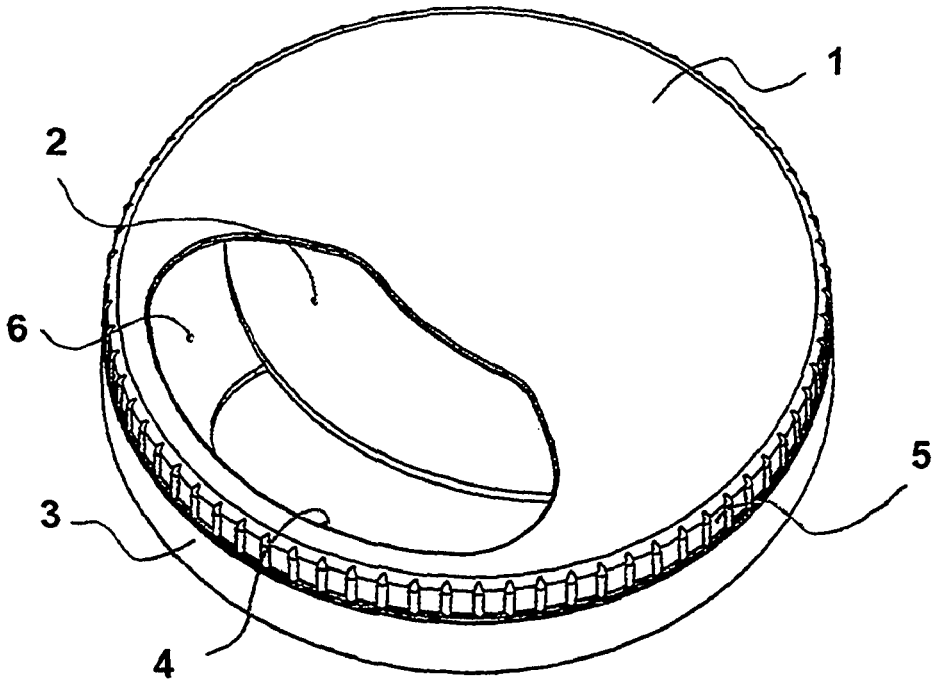
FIG. 2: depicts the assembled plastic closure with a slide opening viewed at an angle from above, in the half-open state.

FIG. 2 depicts this plastic closure in the already half-open state. Opening is effected by rotating the rotating cap 1 in an anti-clockwise direction with one hand, while the other hand grips the bottle or the container firmly. The gate cap 3 attached to the bottle or the container remains stationary in conjunction with this. The ribbed edge 5 is used to rotate the rotating cap 1. The act of rotating the rotating cap 1 in relation to the subjacent gate cap 3 brings about a translational displacement of the slide 2. In this particular case, this has already been pulled out by a small amount from the sectoral pouring hole in the rotating cap 1. A section of the cover 6 of the gate cap can be seen under the slide 2.

Figure 3:
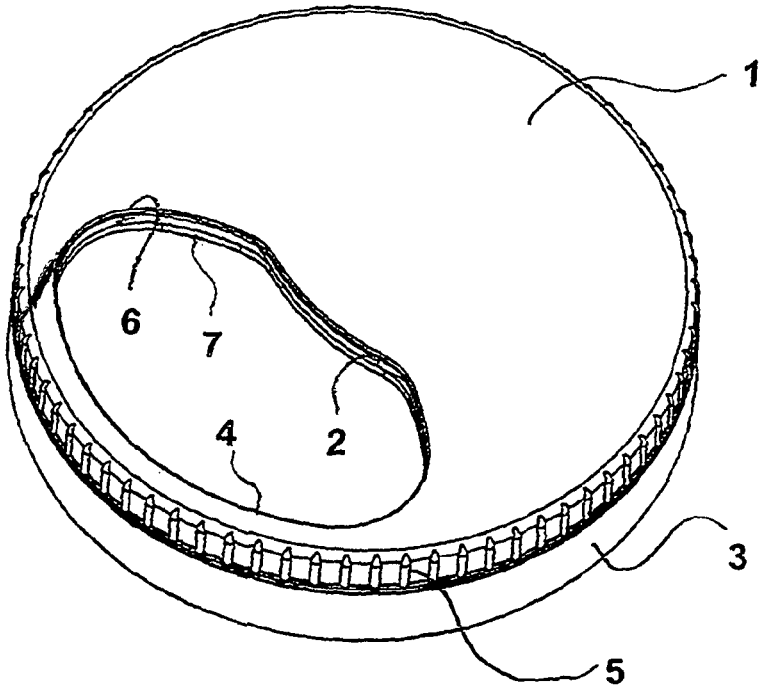
FIG. 3: depicts the assembled plastic closure with a slide opening viewed at an angle from above, in the open state.

The plastic closure with a fully opened slide opening is depicted in FIG. 3. In this state, the pouring hole in the rotating cap 1 lies precisely above that in the gate cap 3, and the slide 2 is retracted in its entirety from these holes. The edge 7 of the emptying hole in the cover 6 of the gate cap 3 can be seen at the very bottom, and the edge 4 of the pouring hole in the rotating cap 1 can be seen at the very top. The front edge of the retracted slide 2 is apparent in between.

Figure 4:
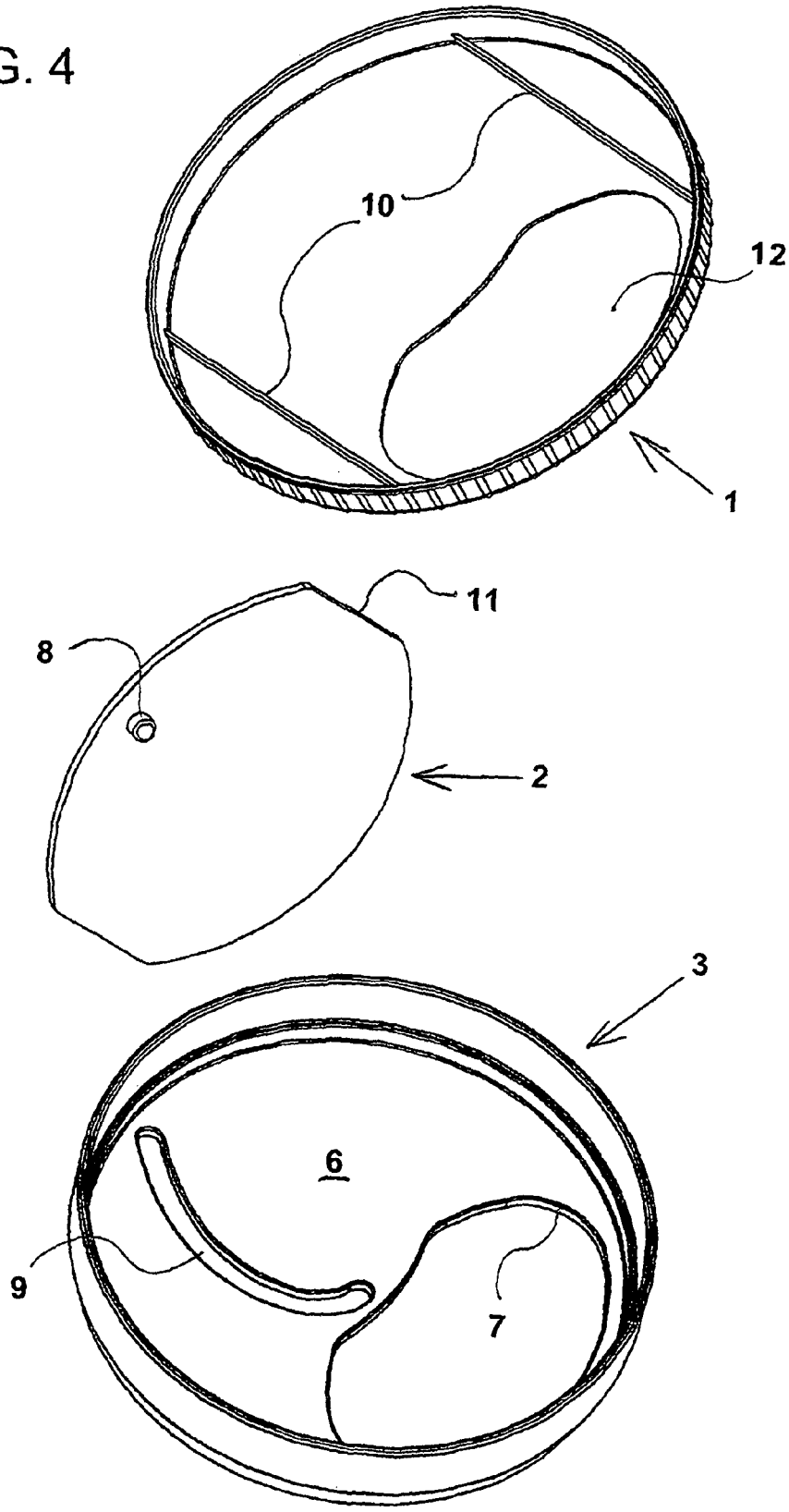
FIG. 4: depicts the individual parts of the plastic closure with a slide opening.

To ensure that the mechanical interaction of these three parts is clearly appreciated, the closure is described below in its disassembled state. FIG. 4 thus depicts the three individual parts of the plastic closure with its slide opening. The rotating cap 1 with the pouring hole 12 will be appreciated initially at the top, the rotating cap 1 being illustrated here as a view towards its under side. This pouring hole extends over an angular sector of the rotating cap 1, and at least over a sector of 90°. In the radial direction, the pouring hole extends over about ¾ of the radius of the rotating cap 1, in conjunction with which it commences externally in the vicinity of the edge of the rotating cap 1. Two guide rails 10 are formed on the under side of the rotating cap 1, and it exhibits a downward projecting edge externally. The slide 2 can be seen underneath the rotating cap 1, although the slide is illustrated here from a different angle of observation. This slide 2 is inserted between the guide rails 10 on the rotating cap 1. Its two opposing, straight slide sides 11 are inserted between or into the guide rails 10. For this purpose, these slide sides 11 can be executed as springs, and the associated guide rails 10 can form grooves so that each slide 2 is retained along a spring-groove connection in the rotating cap 1 after insertion. As a variant, however, the slide 2 can simply be laid loosely, although with a perfect fit, between the two guide rails 10. Formed on the under side of the slide on one side is a cam 8, the function of which will become clear. The gate cap 3 is depicted at the bottom, in this case viewed from above towards its under side. A transcurrent slot is let into the cover 6 of this gate cap 3, which slot acts as a gate guide 9. The pouring hole with its edge 7 is present opposite this gate guide 9. In terms of its size and form, this coincides precisely with the pouring hole in the rotating cap 1. The projecting edge of this gate cap 3 exhibits a bead at its outermost end on the inside, so that the gate cap 3 can be pressed onto a bottle neck or a container spout and is then retained immovably on this neck or spout. However, the edge can also be provided on its inside with a thread having a small pitch, so that the gate cap 3 is capable of being screwed onto a neck thread. It is then screwed onto the neck so tightly that operation of the closure does not undo the threaded connection. If necessary, inserted rubber elements can also be used to increase the frictional force.

Figure 5:
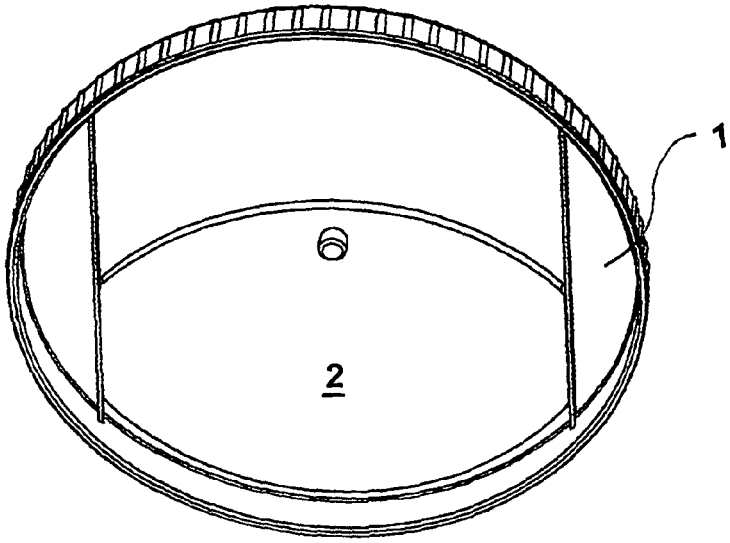
FIG. 5: depicts the rotating cap with the slide inserted in the closed position of the slide.
Figure 6:
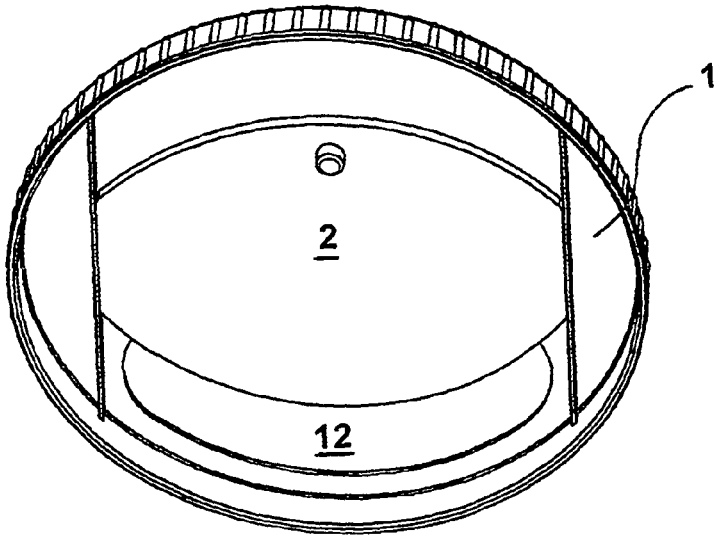
FIG. 6: depicts the rotating cap with the slide inserted in the half-open position of the slide.
Figure 7:
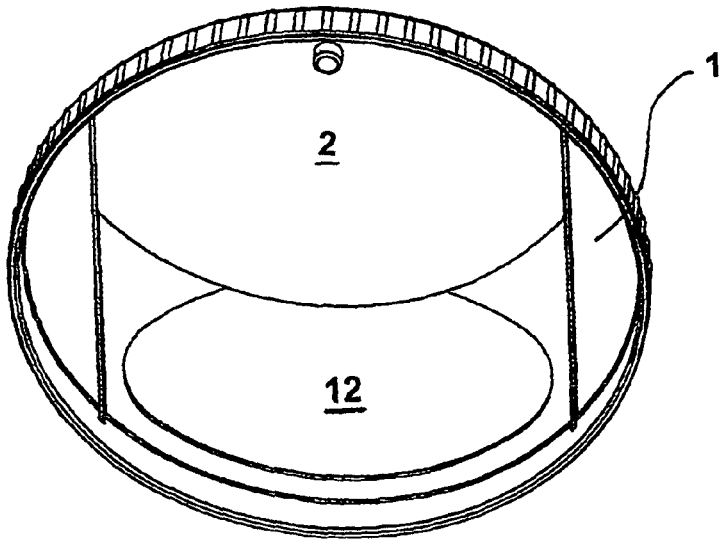
FIG. 7: depicts the rotating cap with the slide inserted in the open position of the slide.

FIG. 5 depicts the rotating cap 1 with the slide 2 inserted in the closed position, although the gate cap is omitted from this view. FIG. 6 then depicts the rotating cap with the slide inserted in the half-open position. A part of the pouring hole 12 in the rotating cap 1 can already be appreciated here, and finally FIG. 7 depicts the rotating cap 1 with the slide 2 inserted in the open position. The pouring hole 12 in the rotating cap 1 is revealed clearly here.

Figure 8:
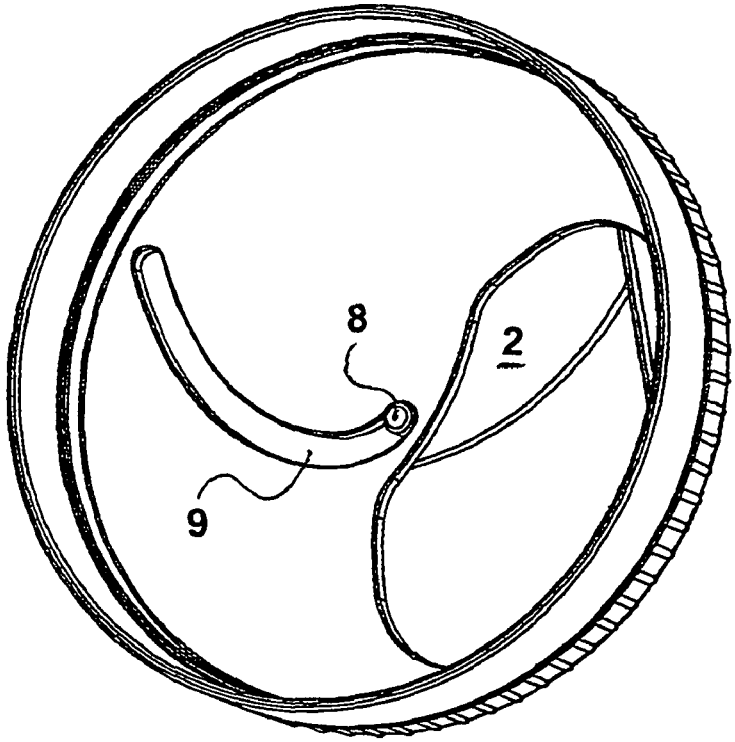
FIG. 8: depicts the rotating cap with the slide and the gate cap viewed from below with the slide in the closed position.
Figure 9:
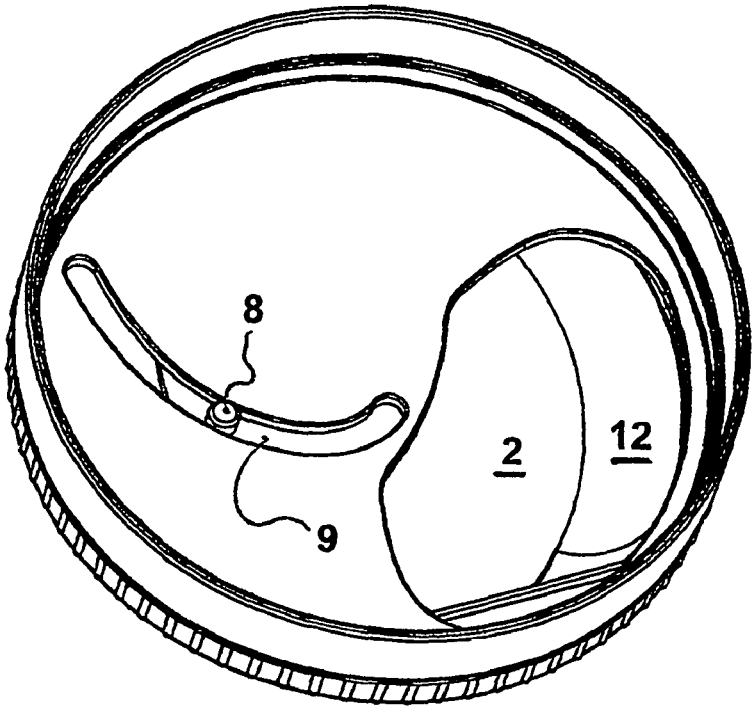
FIG. 9: depicts the rotating cap with the slide and the gate cap viewed from below with the slide in the half-open position.
Figure 10:
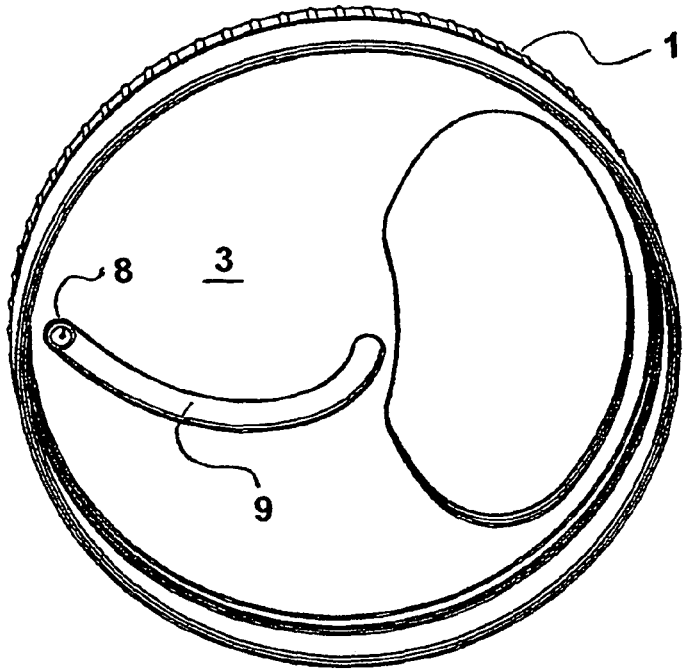
FIG. 10: depicts the rotating cap with the slide and the gate cap viewed from below with the slide in the open position.

FIG. 8 now depicts the assembled closure with the rotating cap 1 with the slide 2 and the gate cap 3 viewed from below with the slide 2 in the closed position. As can be appreciated, the cam 8 on the under side of the slide 2 projects into the gate guide 9. In the closed position of the slide 2 depicted here, the cam 8 is present at one end of the gate guide 9. Depicted in FIG. 9 is the condition after the rotating cap 1 has been caused to rotate by a small amount in relation to the gate cap 3. This rotation also causes the slide 2 on the rotating cap 1 to rotate and, in a corresponding manner, the cam 8 on the slide 2. The cam 8 is guided by the gate guide 9, however, and is caused to move by the deformation of the gate guide 9 with an initially tight and constantly increasing radius, so that the cam 8 describes a radial movement in relation to the rotating cap 1 and, in a corresponding manner, the slide 2 on the rotating cap 1 describes a displacement movement of a translational kind between the guide rails 10. Once the cam 8 has arrived at the other end of the gate guide 9, as depicted in FIG. 10, the slide 2 is in the open position.

Figure 11:
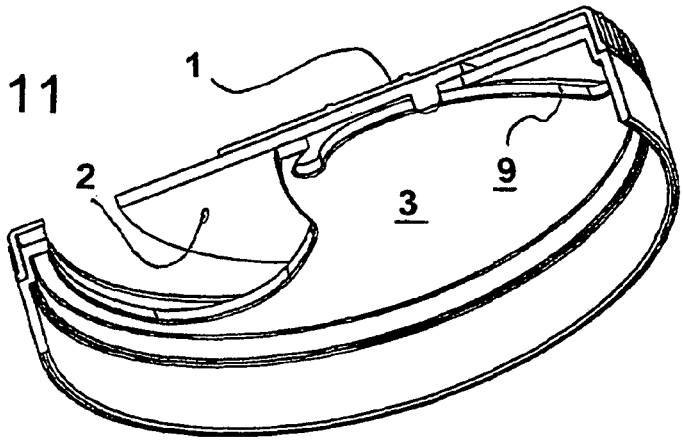
FIG. 11: depicts the rotating cap with the slide and the gate cap in a cross section, with the slide in the half-open position.
Figure 12:
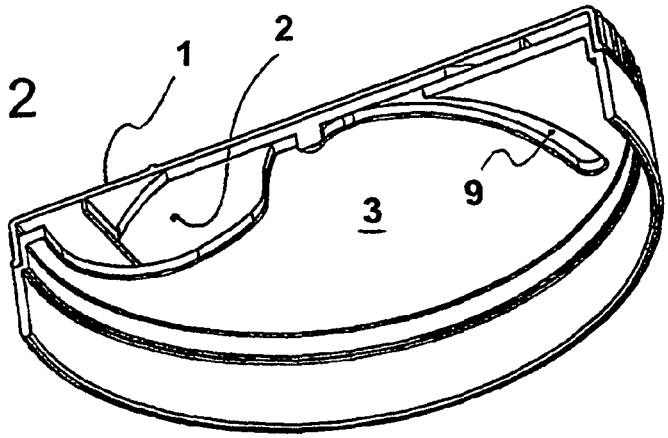
FIG. 12: depicts the rotating cap with the slide and the gate cap in a cross section, with the slide in the closed position.

A cross section through the rotating cap 1 with the slide 2 and the gate cap 3, with the slide 2 in the half-open position, can be seen in FIG. 11, whereas in FIG. 12 the slide is standing in the closed position. As can be appreciated, the gate cap 3 is executed in such a way that it forms a narrow shoulder on its outer edge, on which the rotating cap 1 rests and is guided with its downward-projecting edge. The outer edge of the rotating cap 1 is provided with ribs, of course, so that it can be rotated easily in relation to the gate cap 3. In conjunction with this, the slide 2 with the cam 8 rotates with the rotating cap 1, and the cam 8 is caused to be displaced along the rotating gate guide 9, which gives rise to a translational displacement of the slide 2. On rotating the rotating cap 1 in the anticlockwise direction, that is to say towards the left when viewed from above, the slide 2 is displaced into the open position, and on rotating the rotating cap 1 in the opposite direction, the slide 2 is displaced back into the closed position.

The invention claimed is:

1. A plastic closure with a slide opening for a bottle neck or a container spout, the plastic closure comprising:

a rotating cap having a pouring hole and two substantially parallel guide rails formed on an under side of the rotating cap;

a slide guided on an under side of the rotating cap so constructed and arranged so as to be displaced in a translational manner in relation to the pouring hole, the slide comprising a cam and a straight guide side on two opposing sides of the slide, the two opposing sides guided loosely between the two guide rails of the rotating cap; and a gate cap fitting into the under side of the rotating cap, the gate cap having an emptying hole and a groove as a gate guide, into which groove the cam of the slide projects, wherein the rotating cap is capable of rotation on the gate cap, the gate cap intended for stationary installation on the bottle neck or the container spout, and wherein a relative movement of the rotating cap and the gate cap produces a displacement of the cam along the gate guide so that the slide is capable of displacement in a translational manner into an open position and a closed position.

2. The plastic closure according to claim 1 wherein the pouring hole extends over an angular sector of the rotating cap and the gate cap of at least 90°.

3. The plastic closure according to claim 1 wherein the pouring hole extends in an angular sector of the rotating cap and the gate cap, starting from a point close to the edge, over at least ¾ of the radius.

4. The plastic closure according to claim 1 wherein the rotating cap and the gate cap are provided along their periphery with a snap-in element, so that they are capable of being clicked into engagement with one another, although in an assembled state they are also capable of rotation in relation to one another.

5. A plastic closure comprising:

a slide opening for a bottle neck or a container spout;

a rotating cap having a pouring hole and two substantially parallel guide rails formed on an under side of the rotating cap;

a slide on an underside of the rotating cap capable of being displaced in a translational manner in relation to the pouring hole and comprising a straight guide side on two opposing sides of the slide, the two opposing sides guided loosely between the two guide rails of the rotating cap; and a cam attached to the slide and protruding from the rotating cap for closing and opening the pouring hole, and a gate cap that is received by an under side of the rotating cap having, an emptying hole and a groove as a gate guide, into which groove the cam of the slide projects, the rotating cap being capable of rotation on the gate cap, relative movement of the rotating cap and the gate cap produces a displacement of the cam along the gate guide so that the slide is capable of displacement in a translational manner into an open position and a closed position.

* * * * *